US005231760A

United States Patent [19]

Koster et al.

[11] Patent Number: 5,231,760

[45] Date of Patent: Aug. 3, 1993

[54] SHAVING APPARATUS

[75] Inventors: Marinus P. Koster, Eindhoven, Netherlands; Ferdinand Sereinig, Velden, Austria; Albert Visscher, Eindhoven; Albert J. Meijer, Groningen, both of Netherlands

[73] Assignee: U.S. Philips Corp., New York, N.Y.

[21] Appl. No.: 771,272

[22] Filed: Oct. 3, 1991

[30] Foreign Application Priority Data

Oct. 4, 1990 [EP] European Pat. Off. ..... 90202629.3

[51] Int. Cl.[5] ..... B26B 19/20; B26B 19/00; B26B 19/02

[52] U.S. Cl. ..... 30/43; 30/43.3; 30/43.92

[58] Field of Search ..... 30/43.3, 43.7, 43.91, 30/43.92, 42, 43

[56] References Cited

U.S. PATENT DOCUMENTS

| | | | |
|---|---|---|---|
| 2,263,747 | 11/1941 | Stein | 30/43.3 |
| 3,156,045 | 11/1964 | Godefroy | 30/43.3 |
| 3,618,209 | 11/1971 | Battigalli | 30/43.3 |
| 4,115,920 | 9/1978 | Ascoli | 30/43.3 |
| 4,570,499 | 2/1986 | Durr | 30/43.91 |
| 4,993,152 | 2/1991 | Deubler | 30/43.92 |
| 5,050,301 | 9/1991 | Apprill, Jr. | 30/43.3 |

FOREIGN PATENT DOCUMENTS

| | | | |
|---|---|---|---|
| 0387490 | 9/1990 | European Pat. Off. | 30/43.3 |

*Primary Examiner*—Frank T. Yost
*Assistant Examiner*—Paul M. Heyrana, Sr.
*Attorney, Agent, or Firm*—Ernestine C. Bartlett

[57] ABSTRACT

A shaving apparatus is provided which comprises a housing having a shaving head carrying an external shaving member with hair-entry apertures and an internal shaving member which is coupled to a motor in the housing and which is drivable relative to the external shaving member with a combined movement, the combined movement comprising an oscillatory rotation about an axis of rotation of the internal shaving member and a reciprocating movement in the direction of the axis of rotation. The internal shaving member is provided with a support which is flexible in the direction of the axis of rotation but which is stiff in directions transverse to said direction of the axis of rotation, and the support rotatably supports an internal shaving-member holder which is coupled to the motor. The external shaving member is secured to a frame and is movable relative to the shaving head against spring force in a direction transverse to the axis of rotation, the frame and the shaving head being provided with corresponding guide means.

8 Claims, 5 Drawing Sheets

SHAVING APPARATUS

FIELD OF THE INVENTION

The invention relates to a shaving apparatus comprising a housing having a shaving head carrying an external shaving member with hair-entry apertures and an internal shaving member which is coupled to a motor in the housing and which is drivable relative to the external shaving member with a combined movement, the combined movement comprising an oscillatory rotation about an axis of rotation of the internal shaving member and a reciprocating movement in the direction of the axis of rotation.

BACKGROUND OF THE INVENTION

Such a shaving apparatus is known, for example from U.S. Pat. No. 2,598,292. In this known apparatus the internal shaving member is arranged to be slidable on a shaft, which gives rise to frictional losses during use of the apparatus. The shaft is supported by resilient elements in the shaving head so that the internal shaving member and the shaft are movable, opposed by spring force, in a direction transverse to the shaft. However, as a result of this, the coupling means between the internal shaving member and the motor should also provide an adequate freedom of movement in this direction, which complicates the construction of these coupling means.

SUMMARY OF THE INVENTION

An object of the invention is to provide a shaving apparatus of the type defined above, whose construction is as simple as possible and which minimizes frictional losses.

To this end the invention is characterized in that the internal shaving member is provided with a support which is flexible in the direction of the axis of rotation but which is stiff in directions transverse to said direction of the axis of rotation, and the support rotatably supports an internal shaving-member holder which is coupled to the motor, the external shaving member being secured to a frame and being movable relative to the shaving head against spring force in a direction transverse to the axis of rotation, the frame and the shaving head being provided with corresponding guide means.

BRIEF DESCRIPTION OF THE DRAWINGS

The invention will now be explained by means of a description of two exemplary embodiments shown in the Figures.

DETAILED DESCRIPTION OF THE PREFERRED EMBODIMENTS

Figure 1:
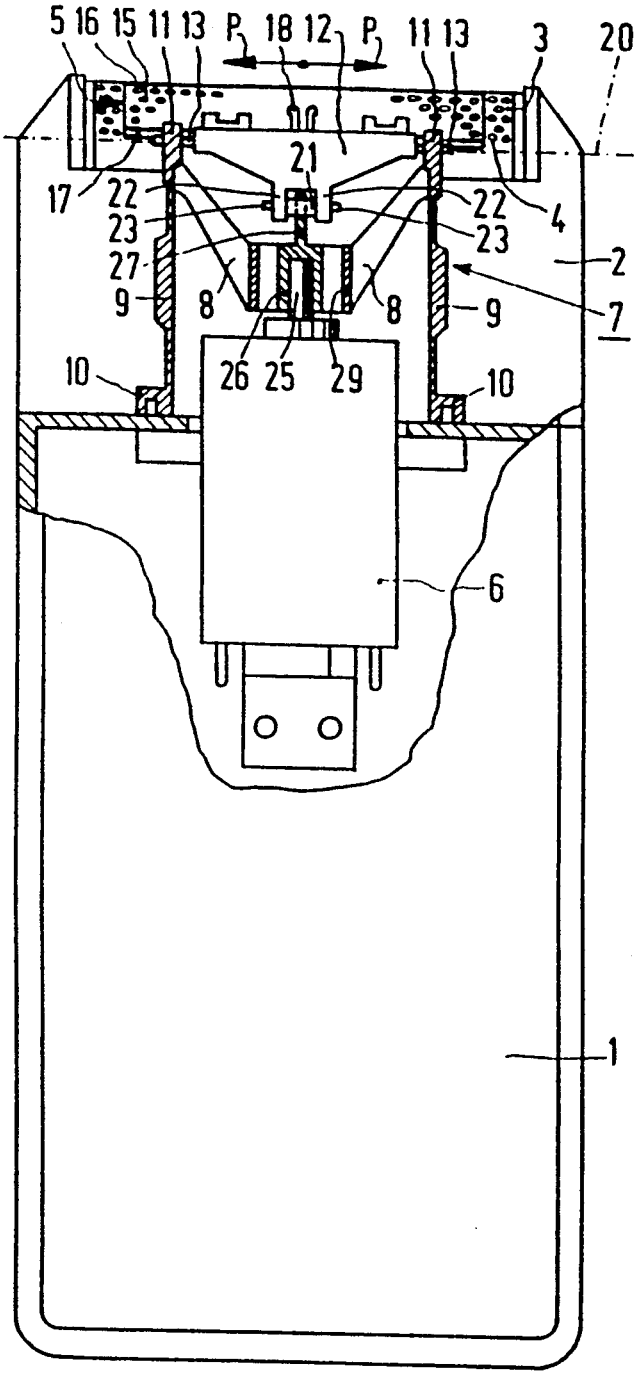
FIG. 1 shows a shaving apparatus in accordance with the invention in a front view and partly in a sectional view taken on the line I—I in FIG. 2.

The shaving apparatus shown in the FIGS. 1 to 6 comprises a housing 1 provided with a shaving head 2 having an external shaving member 3 with hair-entry apertures 4 and an internal shaving member 5 which is constructed to be driven with a combined movement relative to the external shaving member 3. For this purpose the internal shaving member 5 is coupled to an electric motor 6 accommodated in the housing 1.

Figure 2:
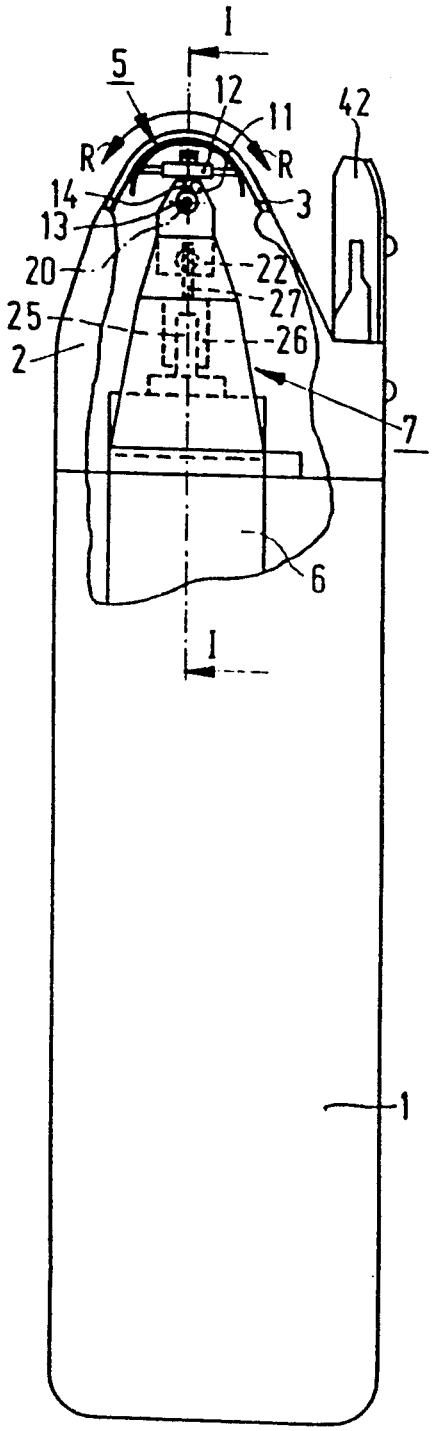
FIG. 2 shows the shaving apparatus shown in FIG. 1 in a side view and with a partly removed side wall.
Figure 3:
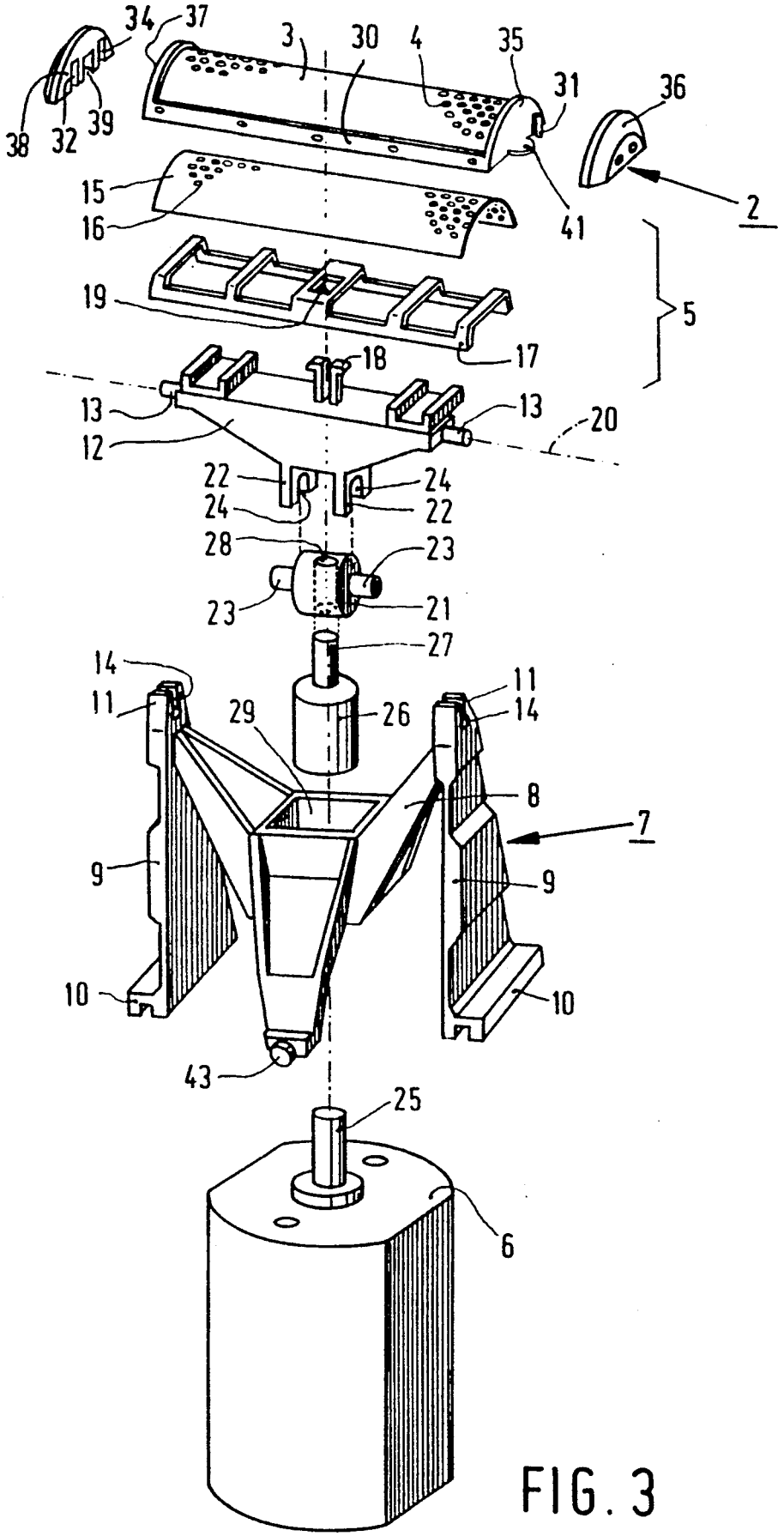
FIG. 3 is an exploded view showing parts of the shaving head, the shaving members, the motor and the interposed drive system.

The drive system for the internal shaving member 5 is shown only diagrammatically in FIGS. 1 and 2. For the following description reference is made mainly to the more detailed FIG. 3. The internal shaving member 5 is provided with a support 7, which is molded in one-piece from a plastics material and mainly comprises a V-shaped yoke 8 and flexible integral hinges 9. The ends 10 of the integral hinges 9 are secured to the shaving head 2. The support 7 rotatably supports an internal shaving-member holder 12 which is arranged to be rotatable between the end portions 11 and the V-shaped yoke 8. For this purpose the shaving-member holder 12 comprises trunnions 13 engaging in widening slots 14 in the end portions 11.

The internal shaving member 5 comprises an arcuate foil 15 with apertures 16 and a frame 17. The foil 15 is fastened to the frame 17, for example by spot welding. The internal shaving member 5 is detachably connected to the holder 12 with the aid of resilient hooks 18 which engage the central opening 19 in frame 17.

In this way the assembly comprising the internal shaving member 5 and the shaving-member holder 12 is rotatable about an axis of rotation 20 at the location of the trunnions 13. A coupling member 21 is rotatably supported between two limbs 22 of the shaving-member holder 12. For this purpose the coupling member 21 comprises trunnions 23 engaging in corresponding slots 24 in the limbs 22.

The electric motor 6 is of the rotary type. An output shaft 25 of the motor 6 has a hub 26 with an eccentric drive pin 27. This drive pin 27 engages a central bore 28 in the coupling member 21. The output shaft 25 with the hub 26 and the eccentric drive pin 27 extend through a central opening 29 in the yoke 8 without touching this yoke. The rotation of the drive shaft 25 will cause the assembly comprising the shaving-member holder 12 and the internal shaving member 5 to perform an oscillatory rotation about the axis of rotation 20 in the direction R as indicated in FIG. 2. Also as a result of the rotation of drive shaft 25 the assembly comprising the yoke 8, the shaving-member holder 12 and the internal shaving member 5 will reciprocate in the direction of the axis of rotation 20, as is indicated by P in FIG. 1.

Owing to this combined movement of the internal shaving member 5 relative to the external shaving member 3 every point of the foil 15 of the internal shaving member 5 covers a substantially larger distance per unit of time when in the case of, for example, a pure reciprocating movement. This leads to a substantial increase of the cutting probability of the shaving apparatus. This is particularly so when the internal shaving member 5 is a shear foil, because the apertures therein form cutting edges in all the directions of movement. The integral hinges 9 then constitute supporting elements which are flexible in the direction of the axis of rotation 20 but which are stiff in directions transverse thereto, thereby precluding a lateral excursion of the internal shaving member 5 as a result of the oscillatory rotating drive in the directions R. Moreover, it is no longer necessary to provide rectilinear guidance for the internal shaving member 5, so that attendant frictional losses are also avoided.

Figure 4:
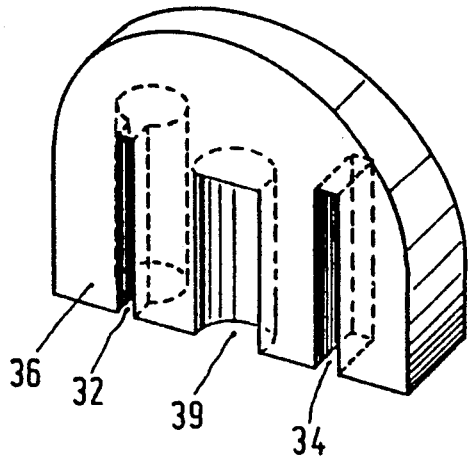
FIG. 4 shows in perspective an end wall of the shaving head.
Figure 5:
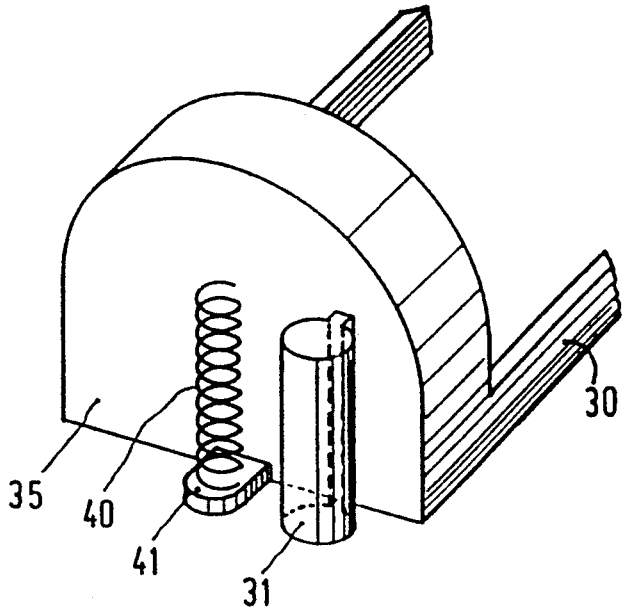
FIGS. 5 and 6 show in perspective parts of the frame of the external shaving member, and FIG. 7 in the same way as FIG. 1 shown a further shaving apparatus in accordance with the invention, the further shaving apparatus comprising a hair-dust seal.
Figure 6:
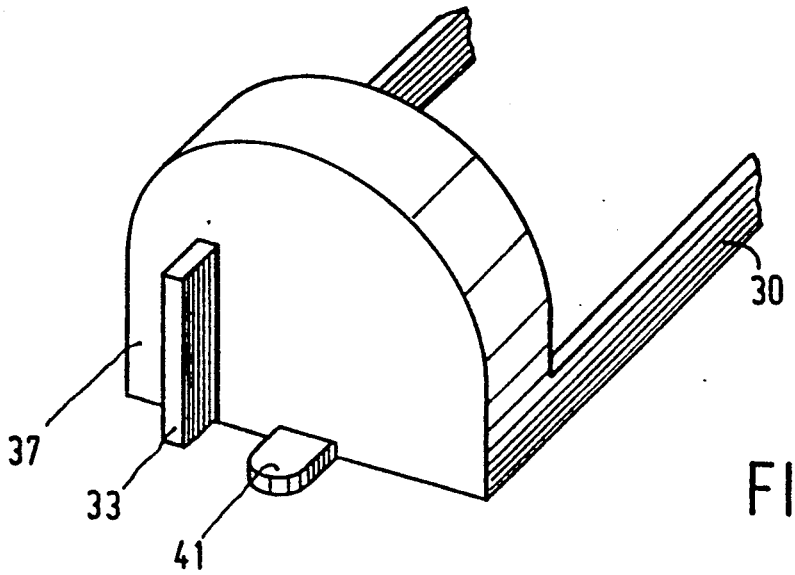

The external shaving member 3 is secured to a frame 30, for example also by spot welding, and is movable together with the frame 30 relative to the shaving head 2 in a direction transverse to the direction P of the axis of rotation 20. The shaving head 2 and the frame 30 are provided with corresponding guide means 31, 32 and 33, 34 (see also FIGS. 4, 5 and 6). The cylindrical projection 31 on end wall 35 of frame 30 (see FIG. 5) slidingly engages in the correspondingly shaped cavity 32 in the end wall 36 of shaving head 2 (FIG. 4). The cross-sectionally rectangular projection 33 on the other end wall 37 of frame 30 (FIG. 6) slidingly engages in the correspondingly shaped cavity 34 in the end wall 38 (FIG. 3) of shaving head 2.

As the end walls 36 and 38 of shaving head 2 both have cavities 32 and 34 the frame 30 with the external shaving member 3 can be mounted in two positions on the shaving head 2.

Each end wall 36, 38 has a central cavity 39 for a pressure spring 40. This pressure spring 40 abuts on a spring support 41 provided on the end walls 35 and 37. In the position in which the shaving head 2 together with the external shaving member 3 is mounted on the housing 1 the pressure springs 40 are loaded. This ensures that the internal shaving member 5 simple engages with the external shaving member 3 under spring pressure, which is necessary for effective shaving. Thus, the more complicated construction of a resilient mounting of the internal shaving member 5 with its combined movement is avoided.

The frame 30 together with the external shaving member 3 can perform only the movement which is directed inwardly relative to the shaving head 2 as defined by the guide means (31, 32, 33, 34) and cannot perform any movement in other directions, such as for example a rotation in the direction R (FIG. 2). This results in a substantial increase of the efficiency of the apparatus.

The support 7 comprising the yoke 8 and the hinges 9 can be cheaply manufactured as an integral molded part of a plastics material. In operation the yoke 8 performs an oscillating movement and is therefore very suitable for driving an additional vibratory long-hair cutter 42 (FIG. 2) on the shaving apparatus. For this purpose the yoke 8 is provided with a driving pin 43 (FIG. 3) which is coupled to the long-hair cutter 42 in a manner well known in the art.

Figure 7:
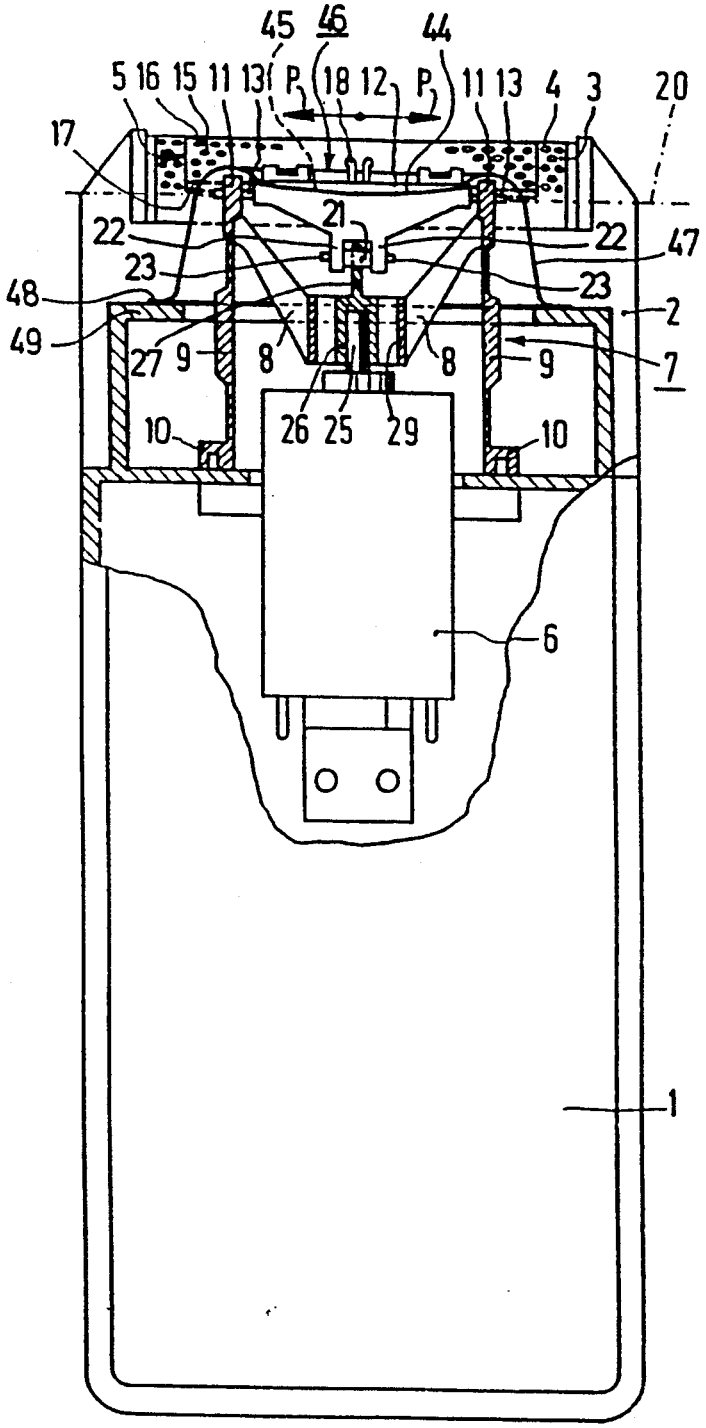

In the shaving apparatus shown in FIG. 7 the internal shaving member holder 12 has a slightly curved groove 44 in its two side walls. These two grooves receive two edge portions of a rubber hair-dust seal 46. The dust seal 46, which substantially has an inverted trough shape, has an opening which is bounded by the edge portions 45 and through which the internal shaving member holder 12 projects with its part facing the frame 17, in particular with its hooks 18. With its four side portions 47 the dust seal 46 completely surrounds the holder 12 and a part of the support 7 and with its end portion 48, which is remote from the edge portions 45, it is connected to portions 49 of the housing 1 in a manner not shown. In this way all the parts of the drive mechanism which move relative to one another, i.e. also the trunnions 13 and the widening slots 14, are protected against hair dust, thereby precluding any disturbance of the movements by hair particles. Since the dust seal 46 is made of rubber it has such a high elasticity that it does not adversely affect the combined movement of the holder 12, which movement comprises a linear component along the axis 20 and an oscillating component in a direction transverse to the axis 20. Preferably, the dust seal 46 has corrugations in those of its two side portions which extend parallel to the side walls of the holder 12, which corrugations may have the same or different longitudinal directions and may be straight or curved. Such corrugations ensue that the seal 46 hinders the holder 12 only to a very small extent and that the seal 46 produces only very weak noises.

We claim:

1. An electric shaving apparatus comprising a housing having a shaving head carrying an external shaving member with hair-entry apertures and an internal shaving member which is coupled to a motor having a drive shaft in the housing and which is drivable relative to the external shaving member with a combined movement, the combined movement comprising an oscillatory rotation about an axis of rotation of the internal shaving member and a reciprocating movement in the direction of the axis of rotation, wherein the internal shaving member is provided with a support which is flexible in the direction of the axis of rotation but which is stiff in directions transverse to said direction of the axis of rotation, and the support rotatably supports an internal shaving-member holder which is coupled to the motor, the rotation of the drive shaft causing the internal shaving member and the shaving-member holder to perform an oscillatory rotation about the axis of rotation, and causing the support, the shaving-member holder, and the internal shaving member to reciprocate in the direction of the axis of rotation, the external shaving member being secured to a frame and being movable relative to the shaving head against spring force in a direction transverse to the axis of rotation, the frame and the shaving head being provided with corresponding guide means.

2. A shaving apparatus as claimed in claim 1, wherein the support is molded in one piece from a plastic material with integral hinges.

3. A shaving apparatus as claimed in claim 2 wherein an eccentric drive pin coupled to the motor engages with a coupling member which is rotatably supported in the shaving-member holder.

4. A shaving apparatus as claimed in claim 2 wherein the holder is connected to an elastic dust seal which at one side completely surrounds the holder except for those parts of the holder to which the internal shaving member is connected, and which at the other side is connected in a dust-tight manner to parts of the housing by its end portion which faces the motor.

5. A shaving apparatus as claimed in claim 1, wherein an eccentric drive pin coupled to the motor engages with a coupling member which is rotatably supported in the shaving-member holder.

6. A shaving apparatus as claimed in claim 5 wherein the holder is connected to an elastic dust seal which at one side completely surrounds the holder except for those parts of the holder to which the internal shaving member is connected, and which at the other side is connected in a dust-tight manner to parts of the housing by its end portions which faces the motor.

7. A shaving apparatus as claimed in claim 1, wherein the holder is connected to an elastic dust seal which at one side completely surrounds the holder except for those parts of the holder to which the internal shaving member is connected, and which at the other side is connected in a dust-tight manner to parts of the housing by its end portion which faces the motor.

8. An electric shaving apparatus comprising a housing having a shaving head carrying an external shaving member with hair-entry apertures and an internal shaving member which is coupled to a motor having a drive shaft in the housing and which is drivable relative to the external shaving member with a combined movement, the combined movement comprising an oscillatory rotation about an axis of rotation of the internal shaving member and a reciprocating movement in the direction of the axis of rotation, wherein the internal shaving member is provided with a support which is flexible in the direction of the axis of rotation but which is stiff in directions transverse to said directions of the axis of rotation, and the support rotatably supports an internal shaving member holder which is coupled to the motor, said support comprising a V-shaped yoke and flexible integral hinges, the ends of the integral hinges being secured to the shaving head and the shaving-member holder being arranged to be rotatable between the end portions of the V-shaped yoke, the rotation of the drive shaft causing the internal shaving member and the shaving-member holder to perform an oscillatory rotation about the axis of rotation, and causing the support, the shaving-member holder, and the internal shaving member to reciprocate in the direction of the axis of rotation, the external shaving member being secured to a frame and being movable relative to the shaving head against spring force in a direction transverse to the axis of rotation, the frame and the shaving head being provided with corresponding guide means.

* * * * *